US005762660A

United States Patent [19]

Makowiecki et al.

[11] Patent Number: 5,762,660

[45] Date of Patent: Jun. 9, 1998

[54] PRECISION REPLENISHABLE GRINDING TOOL AND MANUFACTURING PROCESS

[75] Inventors: Daniel M. Makowiecki; John A. Kerns; Kenneth L. Blaedel; Nicholas J. Colella, all of Livermore; Pete J. Davis, Pleasanton; Robert S. Juntz, Hayward, all of Calif.

[73] Assignee: Regents of the University of California, Oakland, Calif.

[21] Appl. No.: 627,166

[22] Filed: Apr. 3, 1996

[51] Int. Cl.[6] ..... B24D 11/00

[52] U.S. Cl. ..... 51/295; 51/309

[58] Field of Search ..... 51/293, 295, 309

[56] References Cited

U.S. PATENT DOCUMENTS

| | | | |
|---|---|---|---|
| 5,129,918 | 7/1992 | Chattopadhay | 51/309 |
| 5,181,938 | 1/1993 | Krismer et al. | 51/309 |
| 5,271,547 | 12/1993 | Carlson | 51/309 |
| 5,385,591 | 1/1995 | Ramanath et al. | 51/309 |
| 5,389,118 | 2/1995 | Hinterman et al. | 51/295 |

*Primary Examiner*—Deborah Jones

*Attorney, Agent, or Firm*—Henry P. Sartorio; L. E. Carnahan

[57] ABSTRACT

A reusable grinding tool consisting of a replaceable single layer of abrasive particles intimately bonded to a precisely configured tool substrate, and a process for manufacturing the grinding tool. The tool substrate may be ceramic or metal and the abrasive particles are preferably diamond, but may be cubic boron nitride. The manufacturing process involves: coating a configured tool substrate with layers of metals, such as titanium, copper and titanium, by physical vapor deposition (PVD); applying the abrasive particles to the coated surface by a slurry technique; and brazing the abrasive particles to the tool substrate by alloying the metal layers. The precision control of the composition and thickness of the metal layers enables the bonding of a single layer or several layers of micron size abrasive particles to the tool surface. By the incorporation of an easily dissolved metal layer in the composition such allows the removal and replacement of the abrasive particles, thereby providing a process for replenishing a precisely machined grinding tool with fine abrasive particles, thus greatly reducing costs as compared to replacing expensive grinding tools.

29 Claims, 4 Drawing Sheets

PRECISION REPLENISHABLE GRINDING TOOL AND MANUFACTURING PROCESS

The U.S. Government has rights in this invention pursuant to Contract No. W-7405-ENG-48 between the U.S. Department of Energy and the University of California for the operation of Lawrence Livermore National Laboratory.

BACKGROUND OF THE INVENTION

The present invention relates to precision grinding tools, particularly to a process for manufacturing same, and more particularly to a precision grinding tool having abrasive particles intimately bonded thereto via a metal alloy which can be dissolved and the abrasive particles replenished, and to a process for manufacturing the grinding tool.

Computer read-write heads, state-of-the-art engine parts, optics, etc. are made from hard-to-machine materials like certain metals, ceramics and glass. Potential applications for high performance, hard-to-machine material, such as ceramics (i.e., $Si_3N_4$, AlN, cBN), are increasing rapidly as the nation strives to make manufacturing processes and product performance competitive in a global market. These materials are difficult to fabricate into precision components required for today's applications. Also, the actual use of these exotic hard materials is limited by the economics of fabricating precision components. A major cost is the fabrication of precision grinding tools for making the components and the limited useful life of grinding tools. A grinding tool is generally a composite material consisting of small particles of a hard abrasive (i.e., diamond, cubic boron nitride) trapped in a metal or polymer matrix. The difficulties associated with fabricating a composite material with hard abrasive particles into a precision grinding tool are many. Also, usable tool life is limited by the high hardness of ceramic materials shaped in the grinding process.

A common feature of all grinding tools is a precision surface containing the hard abrasive material. In a composite grinding tool this surface consists of abrasive particles bonded in a metal, ceramic, or polymer matrix. The concentration and size of the abrasive particles varies depending on the grinding application. The grinding tool can be fabricated from a monolithic piece of an abrasive-containing composite material or it might consist of one or several layers of abrasive particles bonded to the surface of a ceramic or metal substrate.

The present invention is a grinding tool consisting of a precision machined substrate with a single layer or a specific number of layers of abrasive particles (0.1 to 100 nm in diameter) in a metal matrix bonded to the surface. A unique feature of the invention is the precision control of the composition and thickness of the matrix material and the size of the abrasive particles. A second aspect of the invention is the removal and replacement of the metal matrix material containing the abrasive particles while retaining the precision substrate of the grinding tool. The economic advantages of a replenishable grinding tool fabricated by coating a precisely machined tool substrate with a single layer of fine (0.1–100 μm) abrasive particles are manifold. A single layer or a controlled number of layers of small abrasive particles (0.1–100 nm) can be attached to a precision-machined grinding tool substrate without changing overall dimensions or tolerances. This eliminates the cost involved in shaping a grinding tool to precise final dimensions. The use of a high temperature reactive-metal braze assumes good adhesion of the grinding particles and excellent tool life. The use of metal-coated abrasive particles allows the use of low temperature brazes and solders. This greatly increases the types of materials that can be used as precision substrates (e.g. optical glass). The ability to recoat the precision substrate of a used tool reduces the fabrication costs and increases useful tool life. Also, this invention allows a single layer of very small grinding particles (<2 μm) to be attached to a precision substrate. This makes it possible to substitute monolithic grinding tools for liquid slurrys containing similar size particles in order to produce very smooth and specular surfaces. This reduces process variability and the labor intensive costs inherent in slurry-lapping processes.

SUMMARY OF THE INVENTION

It is an object of the present invention to provide precision replenishable diamond grinding tools.

A further object of the invention is to provide a single-layer diamond grinding tool.

A further object of the invention is to provide a precision machined grinding tool substrate with one or more layers of replenishable abrasive particles.

Another object of the invention is to provide a precision machined grinding tool substrate with at least one layer of abrasive particles bonded thereto and which can be stripped, and a new layer of particles attached to the tool substrate, while maintaining the original tolerances of the substrate.

Another object of the invention is to provide a process whereby diamond powder ranging in size from about 0.1 to 100 microns can be used in fabricating grinding tools.

Another object of the invention is to provide a process for forming grinding tools utilizing a low-temperature brazable alloy to bond the abrasive particles. Another object of the invention is to form grinding tools where the brazable alloy or a metal layer is dissolvable to enable replenishment of the abrasive particles.

Other objects and advantages will become apparent from the following description and accompanying drawings. The present invention involves a grinding tool utilizing one or more layers of abrasive particles (diamond, cubic boron nitride, etc.), and includes a process of stripping the abrasive particles when worn and then recoating the same tool with at least another single layer of abrasive particles of a size ranging from 0.1–100 microns. The fabrication process of the invention can be optimized by controlling the thickness and composition of metallization layers that form a liquid phase or alloy during the brazing process for retaining the abrasive particles in an intimately bonded relation to a precisely configured tool substrate. The invention also involves attaching diamond powder, for example, at significantly lower temperatures by coating the powder and substrate with the metal components of a low-temperature braze. It also involves securing the diamond powder to a tool substrate with dissolvable low-temperature braze materials or the addition of a metal layer that can be easily dissolved to allow removal of the diamond powder. This invention offers a solution to the fabrication problems, high costs, and limited tool life associated with the grinding and polishing of hard materials.

BRIEF DESCRIPTION OF THE DRAWINGS

The accompanying drawings, which are incorporated into and form a part of the disclosure, illustrate an embodiment of the invention and, together with the description, serve to explain the principles of the invention.

FIGS. 6A and 6B are cross-sectional views of embodiments utilizing the multilayer approach for forming the layers of FIG. 2.

DETAILED DESCRIPTION OF THE INVENTION

Figure 1:
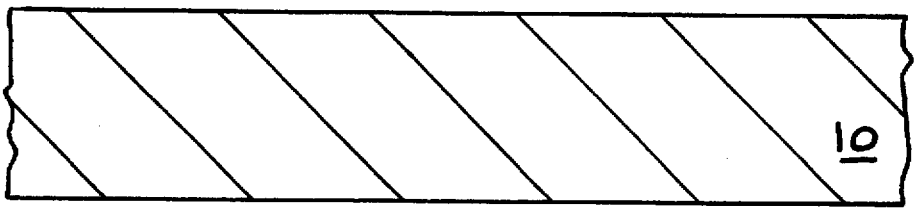
FIGS. 1–5 are partial cross-sectional views which illustrate an operational sequence for producing a precision replenishable grinding tool in accordance with the invention.

The invention is directed to a reusable grinding tool consisting of replaceable abrasive particles (diamond, cubic boron nitride, etc.) intimately bonded to a precisely configured ceramic or metal tool substrate; and to a process for manufacturing same. The manufacturing process involves: coating the tool substrate with layers of metal such as titanium and copper, applying the abrasive particles to the coated surface by a slurry technique, and brazing the abrasive particles to the tool substrate by alloying the metal layers. The metal layers can be deposited, such as by physical vapor deposition (PVD) (i.e. sputtering or evaporation) which provides precision control of the composition thickness of the metal layers that enables the bonding of a single layer or several layers of micron size abrasive particles to the tool substrate. This is accomplished by allowing only enough liquid to form in the braze process to wet the desired number of layers of diamond particles. By incorporating a metal (i.e., copper) that is easily dissolved by a suitable solvent (i.e., nitric acid) into the metal layer composition, such allows the removal and replacement of the abrasive particles while maintaining the precision machined tool substrate. This invention provides a solution to the fabrication problems, high costs, and limited tool life of precision grinding tools. The process of this invention can be optimized by controlling the thickness of the metal layers that form a liquid phase during the brazing process. The invention also enables the attachment of abrasive particles (i.e. diamond powder) at significantly lower temperatures by coating the particles and the substrate with low-temperature braze materials, such as tin and silver or germanium and gold, or gold and silicon.

The present invention is particularly applicable for a grinding tool in which the substrate thereof contains all the complex information about the finished contours of the part. When a single layer of fine diamond powder is chemically attached to the substrate, the contour details that are machined into the substrate are not disturbed by the bonding process.

Experimental verification has confirmed that a single layer (or multiple layers) of diamond powder can be chemically attached to a tool substrate utilizing the process of this invention. Cupped grinding wheels having a single layer of diamond particles using 6–12 micron size diamond powder with a mean particle size of 8 microns have been fabricated. Abrasive particles (diamond powder) ranging in size from about 0.1 to 100 microns can be used to fabricate various grinding tool configurations using the process of this invention. Other very hard abrasive particles, such as cubic boron nitride, titanium carbide, tungsten carbide, and titanium di boride may be utilized in this process. It has also been demonstrated that the single layer or multiple layer abrasive particles attached to a substrate of a grinding tool by the process of this invention, can be readily stripped, and a new layer or layers of particles attached to the tool substrate, while maintaining the original tolerances of the substrate. This is accomplished by utilizing a braze alloy or a metal in the metal layer composition that is readily dissolvable. In the tests carried out, a thick (~10 μm) layer of copper between two layers of titanium provided the dissolvable metal. Further details of the experimental verification of the invention can be found in an article "Single-Layer Diamond Grinding Wheel", J. A. Kerns and D. M. Makowiecki, Engineering Research Development and Technology, FY 94, Thrust Area Report UCRL-53868-94, Chaper 4, Manufacturing Technology, p. 4–7, February, 1995.

The embodiment of the precision grinding tool illustrated hereinafter is for grinding of ceramic materials. Application of this invention is as a precision form tool where the shape and dimensions of the grinding wheel directly determines the shape and the dimensions of the work piece. Examples of such applications are: the plunger of a fuel injector where the angle of the seat must be accurately ground with respect to other features on the plunger; the arbor of blades used in the slicing of silicon wafers; the gang saws for slicing AlTiC wafers of read-urite heads. Also, the precision replenishable diamond grinding tool of this invention can be used in the fabrication of accurate glass optics, etc.

A grinding tool consisting of a tool substrate and a single layer of abrasive grinding particles, is known to those skilled in this technology. However, the use of metal layers deposited by vapor deposition to a precise thickness to effect a bond via a brazing technique to precisely a single layer, or to a specific number of layers, of the abrasive particles is a new concept unique to this invention. The ability to coat a precisely machined substrate with one or more layers of abrasive particles without effecting overall dimensional tolerances is an economical alternative to the labor intensive task of configuring the surface of the grinding tool. Providing a grinding tool whereby the abrasive particles can be stripped and replaced without machining or refinishing the precision tool substrate is also new in this invention. The replaceability of the abrasive particles is accomplished by the use of a braze alloy or the incorporation of copper, for example, in the vapor deposited layers that can be easily dissolved in an acid (i.e., nitric acid). The ability to replenish a used precision machined grinding tool would dramatically decrease the cost of the tool over its usable life.

Figure 2:
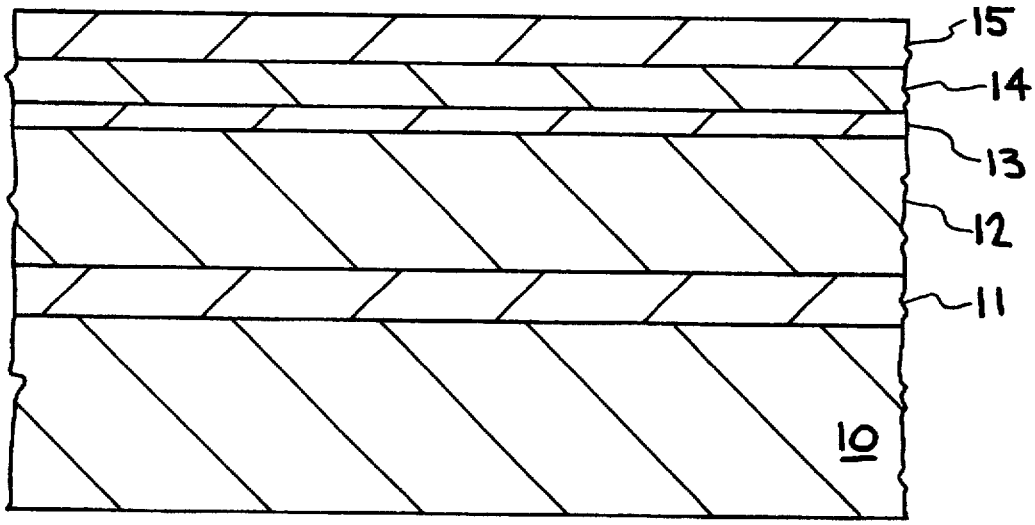
Figure 3:
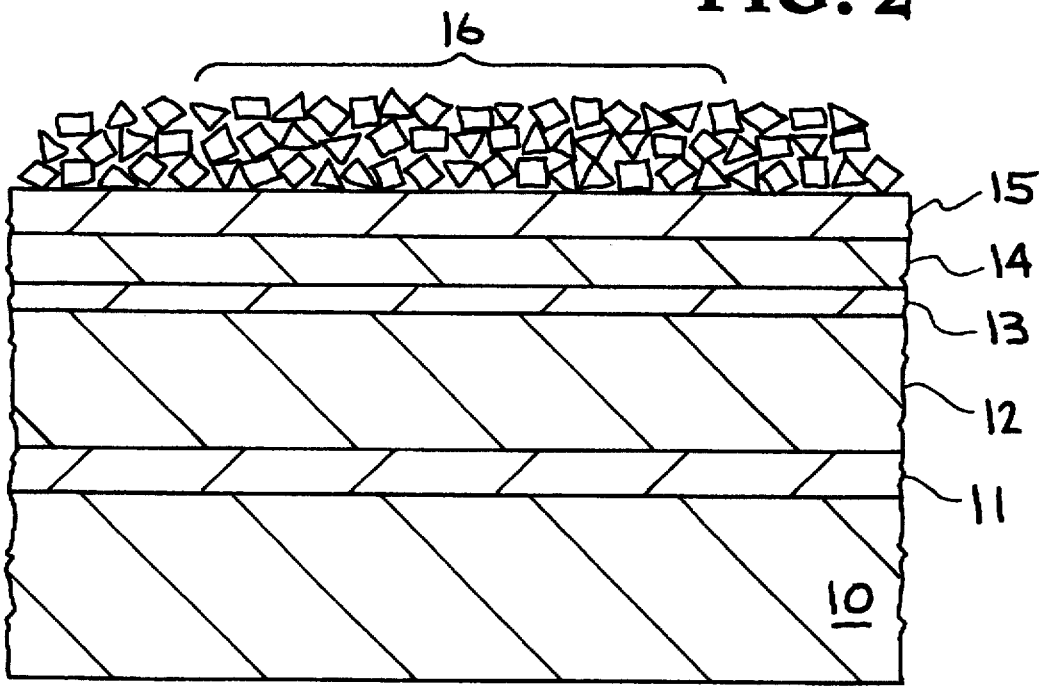
Figure 4:
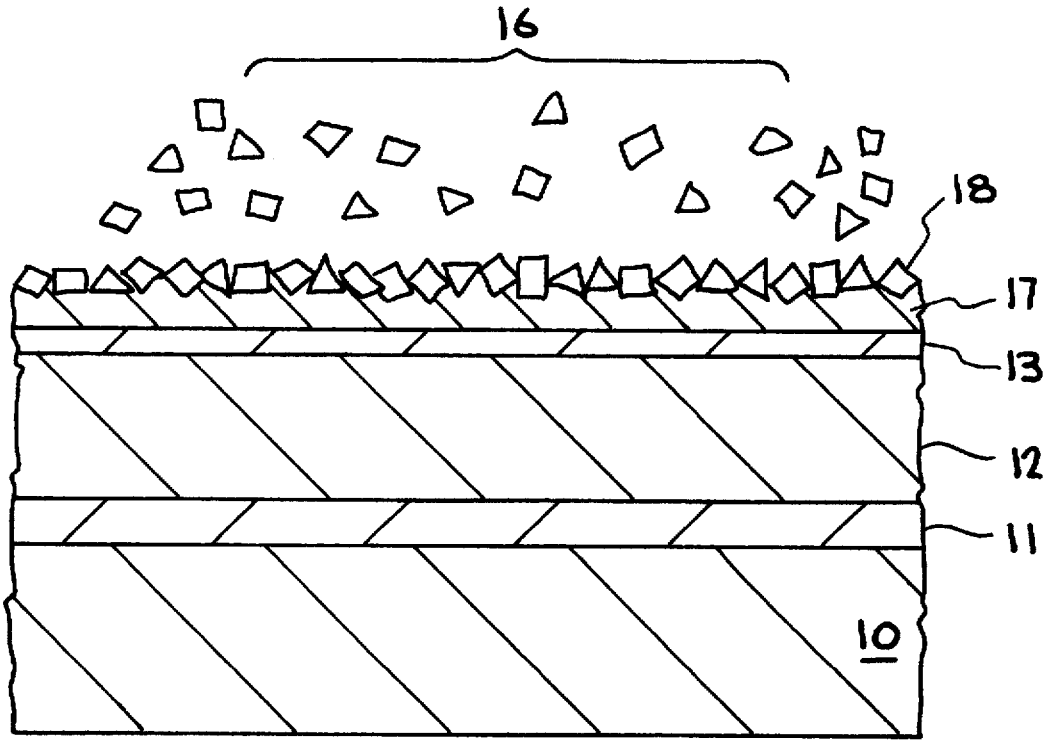

The manufacturing process of this invention is broadly set forth thereafter with reference to FIGS. 1–5:

1. Fabrication of a precision ceramic (i.e., alumina, silicon carbide), glass (i.e., $SiO_2$), or metal (i.e., steel, titanium) tool substrate 10, as shown in FIG. 1.
2. Coating the grinding surface of substrate 10 with successive layers comprising a adhesion layer of titanium (Ti) 11, a layer of copper (Cu) 12, a barrier layer of chromium (Cr) 13, a layer of copper (Cu) 14, and a layer of titanium (Ti) 15, by physical vapor deposition (i.e., sputtering, evaporation), a process well known, as shown in FIG. 2. The layer 14 of copper and layer 15 of titanium constitute a braze alloy when heated. These layers can be a homogeneous alloy of Ti-Cu (72%). When single layers of copper and titanium are used, as shown in FIG. 2, the overall composition must be 72% Cu. Also, multilayers of Cu and Ti having the same composition (72% Cu) may be used.
3. Application of abrasive grinding particles 16, having a size of 0.1–100 microns and composed of diamond or cubic boron nitride, for example, on the coated surface (layers 14–15) of the tool substrate 10, as shown in FIG. 3. The diamond powder is applied by painting with a brush or spraying a slurry of diamond powder in ethanol. Other slurry liquids are water and organic liquids (i.e., alcohols, ketones, hydrocarbons).
4. Heating the coated substrate 10 in a vacuum, hydrogen, or an inert gas to braze the abrasive particles 16 to the tool substrate 10 by alloying the metal layers 14–15 to form a liquid braze, as indicated at 17, and forming a single layer 18 of abrasive particles 16, as shown in FIG. 4.

Figure 5:
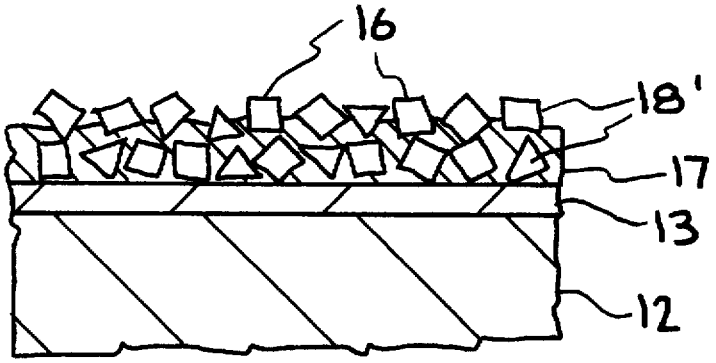

5. By forming the layers 14–15 to a desired thickness, the brazing operation enables the formation of a controlled amount of liquid braze to bond a single layer or a specific number of layers 18" of abrasive particles 16, as shown in FIG. 5.

By way of example, with the layers 11, 12, 13, 14 and 15 having respective thicknesses of 0.5μ, 10μ, 0.2μ, 3μ, and 2.2μ, and with the abrasive particles 14 being composed of 6–12 micron size diamond powder (a mean particle size of 8 microns), the brazing and alloy formation is carried out at a temperature of 900° C. for a time period of 2–30 min., in a vacuum of $1\times10^{-5}$ Torr. If the alloy 17 is formed from a multilayer of Ti and Cu, the total thickness of each is 1.25μ and 1.75μ respectively to maintain the 72% Cu composition. It can also be brazed in hydrogen or an inert gas at atmospheric pressure. The barrier layer 13 prevents the copper in layer 12 from changing the composition of the braze alloy 17 formed from layers 14–15.

To produce tools or wheels with multiple, more than one, layers of abrasive particles, the metal layers 14–15 would be increased in thickness by the diameter of the abrasive particles for each additional layer desired, and the brazing process carried out at a temperature of 900° C. and time period of 2–30 min. in vacuum.

The abrasive particle replenishment feature of the invention is provided by the layer 12 of copper, whereby the alloy 17 can be dissolved. This is accomplished by placing the worn grinding tool in a bath of nitric acid, at a temperature of 30° C. for a time period of 2 hrs. Other acids such as hydrochloric or sulfuric may be used. Other dissolvable metal, such as nickel or molybdenum can be used in place of the copper layer 12, and the composition of the dissolving bath would be determined by the metal of layer 12. If the dissolvable metal is other than copper, a copper layer 1.4 times the thickness of the titanium layer 13 must be included to form a 72% by weight eutectic alloy. Following, removal of the copper layer 12 and the alloy layer 17 and used abrasive particles 16 by disolution, new abrasive particles are bonded to the tool substrate by the above described process. It should be noted that the dissolvable metal layer need not be the center layer, as shown in FIG. 2. The layers 11–15 are composed of an adhesive layer 11 (i.e., titanium, zirconium, or chromium), a dissolvable layer 12 (Cu or Ni, Mo layers plus a 1.4% Cu layer), a barrier layer 13 (Cr, Mo, Nb), a copper layer 14 and a titanium layer 15, which form a braze layer 17, i.e., Ti-Cu (72%). Other alloys such as Au-Ge (27%), Au-Si (31%) can be utilized.

While titanium is used in layer 14, along with copper in layer 15 to form a Ti-Cu alloy 17 containing a layer or layers of abrasive particles 16, the layers 14–15 may be replaced with a layer of Ti-Cu alloy. Layer 11 is an adhesion layer to be included next to the substrate 10, but can be omitted, depending on the composition of the substrate 10 and the metal layer 12.

To bond the abrasive particles in a lower temperature variation of the process the particles can be coated with silver, silicon or germanium, whereby they are bonded to the tool substrate which is coated with tin or gold respectively during the brazing operation. When coated, the thickness of the particle coating is approximately half the diameter of the particle.

The particle coating process involves uniformly coating powder, small particles and fibers with adherent layers of one or more materials by magnetron sputtering, for example, an adhesion layer and a thicker material layer. The process involves agitating the material to be coated to promote uniform coverage by randomizing exposure to the sputter sources. This is accomplished by either vibrating the material at high frequencies with a piezoelectric crystal or tumbling the material in a manner similar to clothing in a dryer. Each of these techniques is described and claimed in copending U.S. application Ser. No. 08/627,162, filed Apr. 3, 1996, entitled "Sputtering Process For Coating Powders", and assigned to the same assignee. The vibrating technique for coating powders, for example, is carried out in a glass bell jar vacuum system equipped with two magnetron sputtering sources, the material to be coated is retained in a pan which is vibrated by a piezoelectric crystal assembly. One of the sputter sources has a titanium target with the other sputter sources having a silver or germanium target. Prior to metal coating the material to be coated is cleaned and static charges removed by exposure to a helium gas plasma. Magnetron sputtering is a well known deposition process and thus specific details thereof is deemed unnecessary. It is essential that each particle is uniformly and completely coated with both the thin adhesion metal and the thin selected material layer or layers.

The manufacturing process of this invention provides the ability to conveniently bond a single layer or a specific number of layers of abrasive particles to the tool substrate. This is accomplished by precisely controlling the thickness of the braze alloy layer 17 in FIG. 4, and such can be varied from 3 μm for a single layer of particles to 15 μm for three layers of (6–12μ) particles, for example. The 3μ of Ti-Cu (72%) braze alloy can be replaced by a multilayer of Ti and copper approximately the same thickness consisting of alternating layers of Ti and copper with thickness ranging from 50 to 10,000 Å. See FIGS. 6A and 7B. The copper layer is 1.4 times thicker than the titanium layer to form the 72% by weight eutectic alloy. For example, if the titanium layer was 1000 Å the copper layer would be 1400 Å. Consequently, only enough liquid phase is formed in the brazing process to wet the single layer or the specified number of layers of abrasive particles. Thus, bonding a controlled number of layers of abrasive particles (<100 μm) to a tool substrate enables the grinding to be designed for various applications. Small particles utilized in previous bonding approaches tend to agglomerate, and thus the capability to bond a single layer of abrasive particles with no agglomeration to a precisely shaped and complicated tool substrate greatly expands the field of grinding tools, since applications from course, flat grinding to precision contoured grinding with narrow tolerance specifications can be accomplished by the present invention, while additionally enabling the reuse of the tool substrate.

Figure 6A:
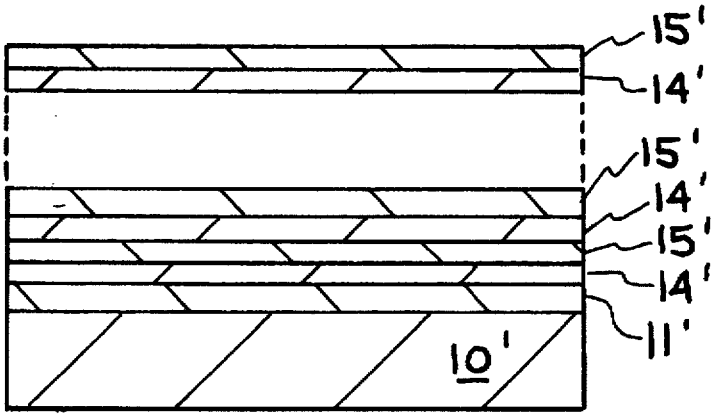
Figure 6A:
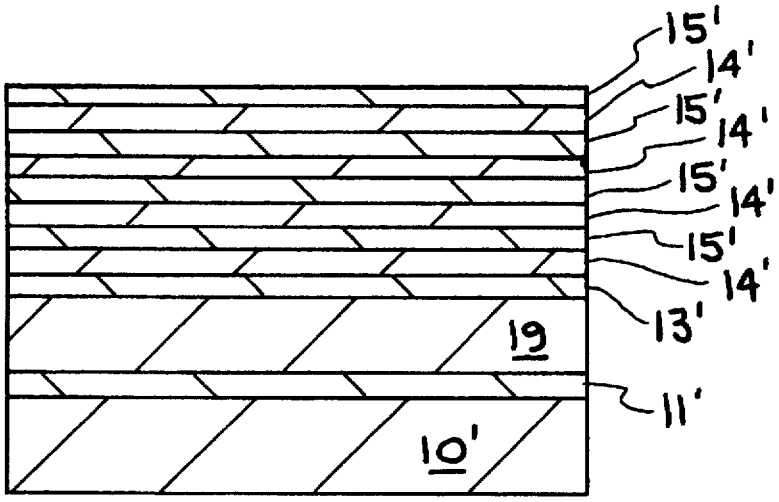

FIGS. 6A and 6B are cross-sectional views of embodiments utilizing the multilayer approach for forming the layers 12 and 13 of FIG. 2 or substitutes for such layers. FIG. 6A is composed of a tool substrate 10' having an adhesion layer 11' of titanium, chromium, or zirconium, followed by alternating multilayers of copper 14' and titanium 15', with the outer or last layer of the multilayer being titanium. The alternating layers 14' and 15' may each range from about 50 Å to 10,000 Å (1μ) and deposited such as by sputtering, so that the alloy is 72% Cu. The multilayers may also be composed of Au/Ge or Ag/Sn in suitable thickness combinations to give weight percent alloys of 27% Ge and 98% Sn, respectively. If desired, the layers 14' and 15' may be varied in thickness so long as the copper content is at least 1.4% greater than the titanium. For example, the total copper amounts a thickness of about 2.3μ while the total titanium has a thickness of 1.8μ. In the FIG. 6A embodiment the adhesion layer 11' can be omitted so long as the initial multilayer is titanium.

FIG. 6B differs from FIG. 6A by the use of a separate copper layer 19 located intermediate an adhesion layer 11' (titanium) and a barrier layer 13' (chromium) followed by alternating multilayers 14' and 15' (copper and titanium), with an outer layer of the multilayers being titanium. The copper layer 19 may have a thickness of 100 Å to 1 μm. In this embodiment the layer 19 is the dissolvable layer and the multilayers 14' and 15' are the braze layers discussed above. A barrier layer 13' is included in FIG. 6B to separate the braze layer 14 from the dissolvable copper layer 12, as in FIGS. 1–5. In either of the embodiments of FIGS. 6A and 6B, the initial layer of the multilayer may be either copper or titanium.

Figure 7A:
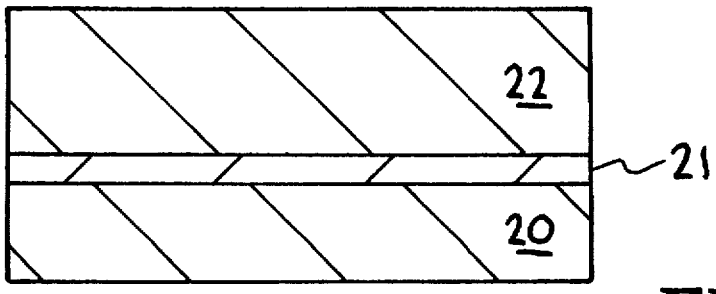
FIGS. 7A–7D are cross-sectional views illustrating variations of the process.
Figure 7B:
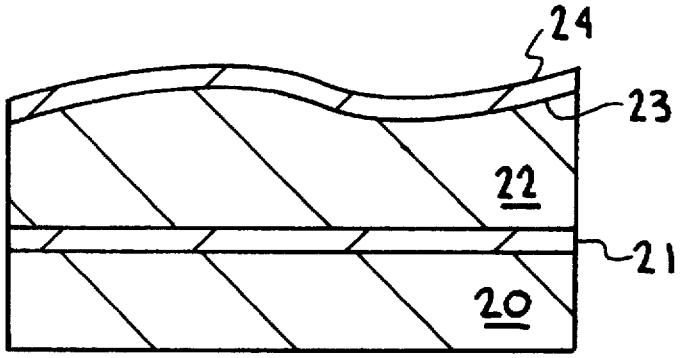
Figure 7C:
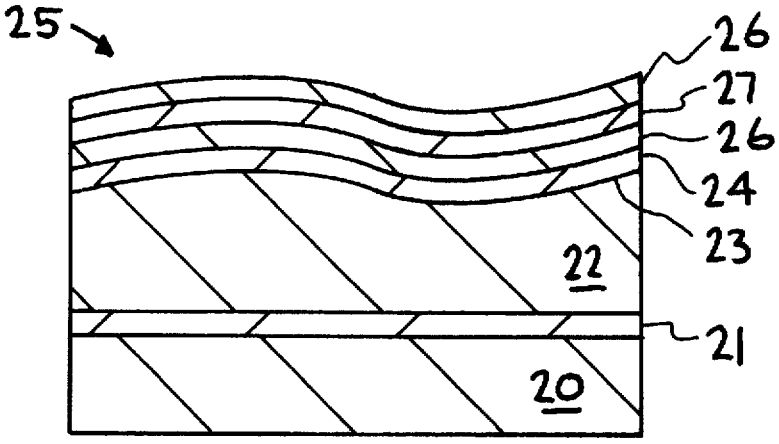
Figure 7D:
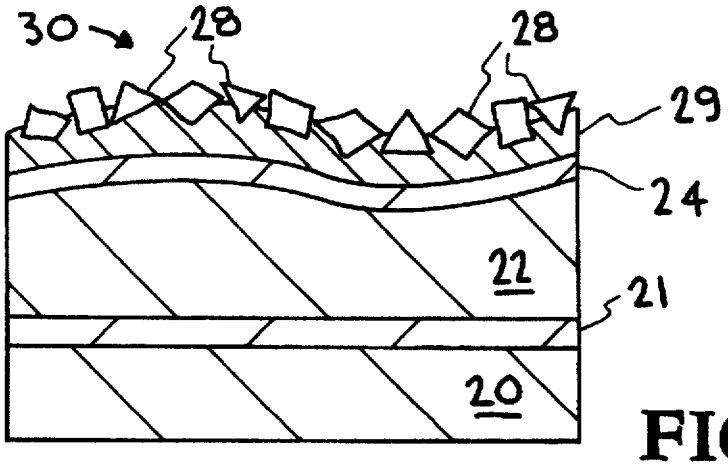

FIGS. 7A, 7B, and 7C and 7D illustrate a variation of the process, wherein the dissolvable layer (metal such as copper) is sufficiently thick (>50 mm), so that it can be precisely machined as the tool substrate to any desired configuration as shown in FIGS. 7B and 7C. Here, as shown in FIG. 7A, a tool 20 has a thin adhesion layer 21 (titanium) as in layer 11 of FIG. 2, on which is deposited a layer of metal 22, such as copper, nickel or molybdenum, which is then annealed at 900° C., followed by precision machining to form the desired surface 23 on which is deposited as barrier layer 24 of chromium, for example, see FIG. 7B, after which a multilayer layer generally indicated at 25, of titanium and copper, for example, is deposited on the barrier layer 24, multilayer 25 of titanium and copper being indicated at 26 and 27, see FIG. 7C. The layer 25 can be a multilayer of titanium-copper, as shown, or a multilayer of gold-germanium, gold-silicon, or silver-tin, as described above with respect to FIGS. 6A–6B. Depending on the composition of metal layer 22, the barrier layer 24 can be omitted. A quantity of abrasive (diamond) particles 28 is positioned on layer 25 (as shown in FIG. 3), and then brazed as described above and shown in FIG. 7D by which to form a titanium-copper alloy layer 29, the diamond particles 28 being secured in the outer surface of the alloy 29. The loose diamond particles are then brushed away. During the brazing operation a quantity of the material from layer 25 (multilayers 26 and 27) form a eutectic alloy 29, as shown in FIG. 7D by which the "diamond particles are secured to tool 20 via machined metal layer 22 to define a surface 30 similar to surface 23. The thickness of the multilayers or alloy 29 determines the layer or layers of thickness of the diamond particles 28 secured therein.

The various layer depositions (without the abrasive particles) which may be utilized in carrying out the present invention are illustrated hereinafter in Table I utilizing, for example, a Ti-Cu (72%) braze alloy.

It is thus seen that the present invention provides a grinding tool having two unique features: 1) the capability to provide a single layer, or a specific number of layers, of abrasive particles on a tool substrate, precision machined or other type; and 2) the capability to replenish a used grinding tool, thereby reducing the costs of replacement of tool substrates, and increasing the usable tool life.

While a particular embodiment, operational sequence, materials, parameters, etc. have been set forth to exemplify the invention, such are not intended to be limiting. Modifications and changes may become apparent to those skilled in the art, and it is intended that the invention be limited only by the scope of the appended claims.

The invention claimed is:

1. A tool having a replenishable grinding surface comprising:

a substrate;

a layer of dissolvable metal;

at least one layer of abrasive particles of a size less than about 100 microns;

said layer of abrasive particles being bonded to said substrate via a metal alloy which includes a dissolvable metal.

2. The grinding tool of claim 1, wherein said dissolvable metals are the same or different and are selected from the group consisting of copper, nickel, and molybdenum.

3. The grinding tool of claim 1, wherein said metal alloy is selected from the group consisting of of Ti-Cu (72%), Ag-Sn (98%), Au-Ge (27%), and Au-Si (31%).

4. The grinding tool of claim 1, wherein said abrasive particles are selected from the group of diamond, cubic boron carbide, titanium carbide, tungsten carbide, and titanium boride.

5. The grinding tool of claim 4, wherein said metal alloy is composed of Ti-Cu (72%).

6. The grinding tool of claim 1, wherein said abrasive particles are coated with low temperature braze materials.

7. The grinding tool of claim 1, wherein said abrasive particles are coated with an adhesion layer, and at least one additional layer of material selected from the group consisting of silver, silicon, and germanium.

8. The grinding tool of claim 1, having a number of layers of abrasive material.

9. The grinding tool of claim 1, having a single layer of abrasive material composed of 6–12 micron diamond powder.

10. The grinding tool of claim 9, wherein said metal alloy is composed of layers of titanium and copper which form a dissolvable Ti-Cu alloy bonding said diamond powder to said tool substrate.

11. The grinding tool of claim 1, wherein said metal alloy is formed from multilayers of material selected from the group consisting of Ti-Cu, Ag-Sn, Au-Ge and Au-Si.

12. The grinding tool of claim 1, additionally including a barrier layer to separate the metal alloy from a layer of dissolvable metal.

13. A process for fabricating a reusable grinding tool by providing a replenishable grinding surface comprising:

depositing a plurality of layers of different selected metals including a dissolvable metal on a surface of a substrate;

applying a quantity of abrasive particles on an outer layer of the plurality of layers to form at least one layer of abrasive particles; and bonding the layer of the abrasive particles to at least the outer layer of the plurality of layers by heating and alloying the plurality of layers of different selected metals to form the replenishable grinding surface of the tool.

14. The process of claim 13, wherein the replenishable grinding surface is replenished by:

removing the alloy and abrasive particles from the surface of the substrate by dissolving the dissolvable metal; and providing a new alloy on the surface of the substrate containing new abrasive particles thereby replenishing the replenishable grinding surface of the tool.

15. The process of claim 13, additionally including forming the substrate to have at least a shaped surface prior to depositing the plurality of layers on the shaped surface.

16. The process of claim 13, wherein the depositing of the plurality of layers of metal is carried out by physical vapor deposition.

17. The process of claim 13, wherein the heating of the metal layers is carried out by a brazing process.

18. The process of claim 13, additionally including coating the abrasive particles prior to applying same on the outer layer of the plurality of metal layers.

19. The process of claim 18, wherein the coating of the abrasive particles is carried out by sputtering, and the coating is composed of Ag, Ge or Si.

20. The process of claim 13, wherein the depositing of the plurality of layers of different selected metal is carried out by depositing three layers of metal, a first layer being of one metal, and the second layer being of a second metal, and a third layer being of the same or different metal as the first layer and including the metal of the second layer or a different metal, at least one of said layers of metal being said dissolvable metal.

21. The process of claim 20, wherein the first layer is selected from the group consisting of titanium, chromium and zirconium;

wherein the second layer is selected from the group of copper, nickel and molybdenum; and wherein the third layer is composed of titanium or composed of alloy formed from multilayers elected from the group consisting of Ti-Cu, Ag-Sn, Au-Ge, and Au-Si.

22. The process of claim 14, wherein the dissolvable metal is copper, and dissolving thereof is carried out in nitric acid.

23. The process of claim 20, wherein the first and third layers are of different metals.

24. The process of claim 20, additionally including depositing a layer of metal on the surface of the substrate prior to depositing the plurality of layers, and forming the surface of the layer of metal to a configuration prior to depositing the plurality of layers, such that the plurality of layers when deposited have a configuration similar to the configuration of the surface of the metal layer.

25. The process of claim 13, additionally including coating the abrasive particles prior to applying same on an outer layer of the plurality of layers.

26. The process of claim 25, wherein the coating of the abrasive particles is carried out using an adhesion layer and then at least one additional layer of material.

27. The process of claim 24, additionally including depositing a barrier layer on the surface of the layer of metal prior to depositing the plurality of layers.

28. The process of claim 13, additionally including depositing an adhesion layer intermediate the substrate and the plurality of layers.

29. The process of claim 21, additionally including depositing a barrier layer selected from the group consisting of Cr, Mo, and Nb intermediate the second layer and the third layer.

* * * * *